US006496088B1

(12) United States Patent
Okada et al.

(10) Patent No.: US 6,496,088 B1
(45) Date of Patent: Dec. 17, 2002

(54) DIELECTRIC FILTER DIELECTRIC DUPLEXER AND COMMUNICATION APPARATUS

(75) Inventors: Takahiro Okada, Ishikawa-ken; Jinsei Ishihara, Kanazawa; Hideyuki Kato, Ishikawa-ken, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/541,291

(22) Filed: Apr. 3, 2000

(30) Foreign Application Priority Data

Apr. 2, 1999 (JP) ..... 11-095928
Feb. 14, 2000 (JP) ..... 2000-034530

(51) Int. Cl.[7] ..... H01P 1/20; H01P 5/12
(52) U.S. Cl. ..... 333/202; 333/206; 333/134
(58) Field of Search ..... 330/202, 206, 330/134

(56) References Cited

U.S. PATENT DOCUMENTS 5,867,076 A * 2/1999 Tada et al. ..... 333/206
5,945,896 A * 8/1999 Miyamoto ..... 333/206
5,952,897 A * 9/1999 Ogura et al. ..... 333/134
6,057,745 A * 5/2000 Sonoda et al. ..... 333/134

FOREIGN PATENT DOCUMENTS

| | | |
|---|---|---|
| EP | 0664572 A1 | 1/1995 |
| EP | 0853349 A1 | 7/1998 |
| EP | 1032070 A1 | 8/2000 |

* cited by examiner

*Primary Examiner*—Patricia Nguyen
(74) *Attorney, Agent, or Firm*—Ostrolenk, Faber, Gerb & Soffen, LLP

(57) ABSTRACT

There is disclosed a dielectric filter, comprising: a dielectric block; a plurality of inner conductor formed holes provided in the dielectric block; inner conductors provided on the inner walls of the inner conductor formed holes; and outer conductor provided on the outer surface of the dielectric block so as to have one opening-face as an open-face of the inner conductor formed holes, and have the other opening-face thereof as a short-circuiting-face; wherein the sectional shape of the inner conductor formed holes are substantially constant in the range from the open-face to the short-circuiting-face, and a step is provided in the intermediate portion of the center axis of at least one inner conductor formed hole.

17 Claims, 12 Drawing Sheets

DIELECTRIC FILTER DIELECTRIC DUPLEXER AND COMMUNICATION APPARATUS

BACKGROUND OF THE INVENTION

1. Field of the Invention

The present invention relates to a dielectric filter and a dielectric duplexer, each having inner conductor formed holes provided inside of a dielectric block, and an outer conductor provided on the outer surface of the block, and a communication apparatus using the same.

2. Description of the Related Art

A conventional dielectric filter using a substantially parallelepiped-shaped dielectric block is formed in which plural inner conductor formed holes having inner conductors on the inner walls thereof are provided, and an outer conductor is provided on the outer surface of the dielectric block. Referring to a dielectric filter of which one end-face functions as an open-face, and the other opposite-end face does as a short-circuiting face, if two adjacent inner conductor formed holes are straight holes having the same inner diameters and straight-line center axes, the resonance frequencies of the even mode and the odd mode between the two resonators composed of the two adjacent inner conductors and the outer conductor become coincident with each other, coupling between the resonators can not be attained.

In order to couple the adjacent two resonators, conventionally, the following methods have been employed.

(1) The resonators are given a step impedance structure by making different the inner diameters on the open-face side and the short-circuiting side of the inner conductor-formed holes, respectively.

(2) The impedances on the open-face side and on the short-circuiting side of the resonators are made different from each other by providing a slit or step for a part of the dielectric block.

(3) An electrode pattern for coupling the resonators is formed on the open-face of the dielectric block.

The above-described conventional dielectric resonators have the following problems to be solved, respectively. In the case of the structure in which inner conductors are formed on the inner walls of inner conductor formed holes, the unloaded Q ($Q_o$) of each resonator is considerably changed with the inner diameter of the inner conductor formed hole. When the ratio of the thickness of a dielectric block to the inner diameter of the inner conductor formed hole is varied, the unloaded Qo has a maximum at a value of the ratio. Whether the ratio is increased or decreased, the $Q_o$ is reduced. Therefore, in the case where the inner diameter of the inner conductor formed hole is made different on the open-face side and the short-circuiting-face side, as described in (1), the inner diameter of the inner conductor formed hole can not be optimized in such a manner that the $Q_o$ has a maximum, for the whole of the inner conductor formed hole.

When a distorted portion such as a slit, a step, or the like, as described in (2), a concentration area is generated in the current distribution of the inner conductors and the outer conductor, so that the $Q_o$ of each resonator is deteriorated.

Further, in the case of the structure in which an electrode pattern is provided on the open-face of an dielectric block, the coupling coefficient as described in (3), the dimensional precision of the electrode printed pattern determines the coupling coefficient between resonators. Accordingly, there arises the problem that a high accuracy is required, and the production is complicated.

SUMMARY OF THE INVENTION

To overcome the above described problems, preferred embodiments of the present invention provide a dielectric filter in which no deterioration of the $Q_o$, is caused by deforming the outer shape and size of the dielectric block, the $Q_o$ of a resonator is optimized, and the adjustment of coupling can be easily performed.

One preferred embodiment of the present invention provides a dielectric filter, comprising: a dielectric block; a plurality of inner conductor formed holes provided in the dielectric block; inner conductors provided on the inner walls of the inner conductor formed holes; and outer conductor provided on the outer surface of the dielectric block so as to have one opening-face as an open-face of the inner conductor formed holes, and have the other opening-face thereof as a short-circuiting-face; wherein the sectional shape of the inner conductor formed holes are substantially constant in the range from the open-face to the short-circuiting-face, and a step is provided in the intermediate portion of the center axis of at least one inner conductor formed hole.

Another preferred embodiment of the present invention provides a dielectric filter, comprising: a dielectric block; a plurality of inner conductor formed holes provided in the dielectric block; inner conductors provided on the inner walls of the inner conductor formed holes so as to have open-ends on the inner walls of the holes; and outer conductor provided on the outer surface of the dielectric block; wherein the sectional shape of the inner conductor formed holes are substantially constant in the range from one opening-face of the holes to the other opening-face, respectively, and a step is provided in the intermediate portion of the center axis of at least one inner conductor formed hole.

In the above described dielectric filter, each of the inner conductor formed holes may have a square cross section.

According to the above described structure and arrangement, no deterioration of the $Q_o$, caused by deforming the outer-shape of a dielectric block, occurs, the Qo of a resonator can be optimized, and the coupling can be easily adjusted.

Preferably, the ratio d/D is 0.2–0.4 where D represents the width in the short side direction of the dielectric block, and d represents the width of the inner conductor formed hole.

According to the above arrangement, the Qo can be easily optimized by relatively determining the inner diameter of an inner conductor formed hole based on the outer-shape of the dielectric block.

Further, the position of the step may be nearer to one opening-face with respect to the center in the longitudinal direction of the inner conductor formed hole, and the interval between the center axis of the inner conductor formed hole ranging from the step to the other opening-face of the inner conductor formed hole and the center axis of an inner conductor formed hole adjacent to the inner conductor formed hole may be substantially two times the interval between each center axis and the corresponding outer conductor.

According to the above described arrangement, a bias in a current flowing through the outer conductor and the inner conductor can be reduced, and the reduction of the Qo can be inhibited. The ratio of the inner diameter of the inner conductor formed hole based on the outer shape of the dielectric block can be optimized not only in the thickness direction of the dielectric block but also in the direction in which the resonators are arranged, and therefore, the Qo can be further optimized.

Yet another preferred embodiment of the present invention provides a dielectric duplexer comprising the plurality of the dielectric filters described above, the dielectric filters being formed in the single dielectric block.

Yet another preferred embodiment of the present invention provides a communication apparatus including the dielectric filter or the dielectric duplexer described above.

According to the above arrangement, a communication apparatus of which the loss in a high frequency circuit section is small can be formed without the size being enlarged as a whole.

Other features and advantages of the present invention will become apparent from the following description of the invention which refers to the accompanying drawings.

DESCRIPTION OF THE PREFERRED EMBODIMENTS

The configuration of a dielectric filter according to a first embodiment will be described with reference to FIGS. 1 to 5.

Figure 1:
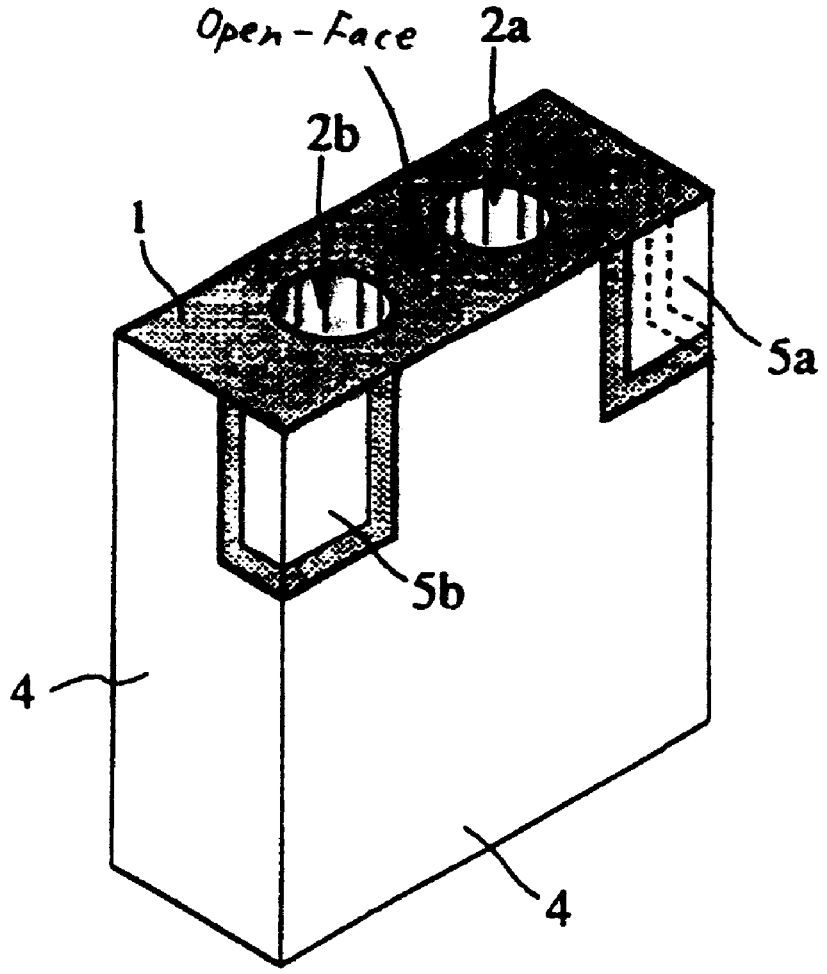
FIG. 1 is a perspective view showing the appearance of a dielectric filter according to a first embodiment.

FIG. 1 is a perspective view showing the appearance of a dielectric filter. In FIG. 1, reference numeral 1 designates a substantially parallelepiped-shaped dielectric block. Inner conductor formed holes 2*a* and 2*b* are formed so as to elongate from the upper end-face of the dielectric block 1 in this figure to the under end-face opposite to the upper end-face in the figure. Regarding the outer surface of the dielectric block 1, the upper end-face viewed in the figure functions as an open-end face, and on the other five faces, an outer conductor 4 is formed. Further, on the outer surface of the dielectric block 1, input-output terminals 5*a* and 5*b* are formed so as to be isolated from the outer conductor 4. Practically, when surface-mounting is carried out on the face lying on this right-hand side, viewed in the figure, which is the face opposed to a circuit substrate, the input-output terminals 5*a* and 5*b* are connected to electrodes on the circuit substrate.

Figure 2A:
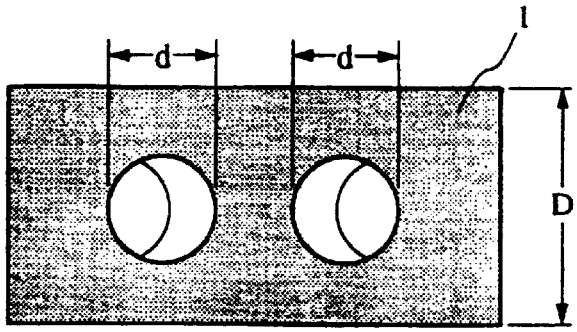
FIGS. 2A and 2B are a front view and a bottom view showing the above dielectric filter.
Figure 2B:
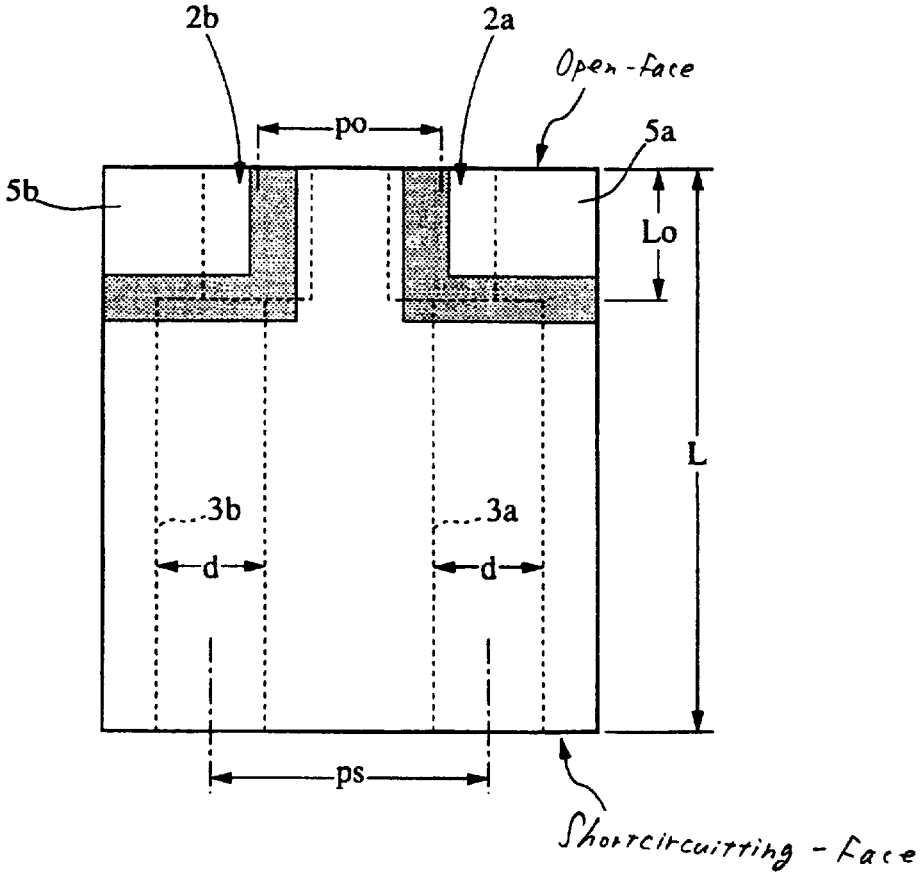

FIG. 2A is a front view showing the open-face side of the above dielectric filter, and FIG. 2B is a bottom plan view. As shown in this figure, for each of the inner conductor formed holes 2*a* and 2*b*, a step is provided with respect to the center axis at the depth from the open-face of $L_o$, so that the resonator pitch (distance between the center axes of the inner conductor formed holes) on the open-face side is $p_o$, and the resonator pitch on the short-circuiting-face side is ps. The inner diameters of the inner conductor formed holes 2*a* and 2*b* are constant over the range from the open-face to the short-circuiting-face, and is represented by d.

Figure 3:
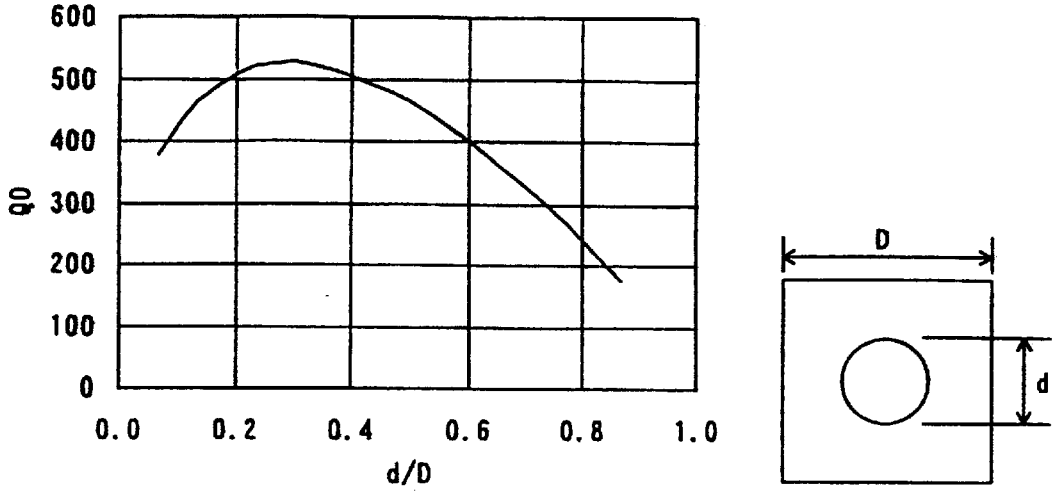
FIG. 3 illustrates an example of the change of the Qo with the ratio of the dielectric block width to the inner diameter of the inner conductor formed hole.

FIG. 3 illustrates the results the $Q_o$ of a resonator which is changed with the ratio of the width d (inner diameter) of an inner conductor formed hole formed coaxially in a dielectric block to the width D in the longitudinal and transverse directions of the dielectric block, and is determined by the finite element method. As seen in the results, in the d/D range of 0.2–0.4, the $Q_o$ have a large value. When the d/D is 0.3, the $Q_o$ becomes maximum. The $Q_o$ tends to be decreased whether the d/D becomes larger or smaller than 0.3. Accordingly, a high $Q_o$ value is secured by setting the width D of the dielectric block shown in FIG. 2, and the width d of the inner conductor formed holes 2*a* and 2*b* to have a relation of d/D=0.2–0.4.

With the above-described structure, coupling between resonators can be attained while each $Q_o$ is optimized with no slit or step being provided for the dielectric block, the inner diameter of the inner conductor formed hole being not changed, and no especial electrodes for coupling resonators being provided on the open-face.

The input-output electrodes 5*a* and 5*b* are capacitance-coupled with the areas near to the open-ends of the inner conductors 3*a* and 3*b* on the inner wall of the inner conductor formed holes 2*a* and 2*b*.

Figure 4A:
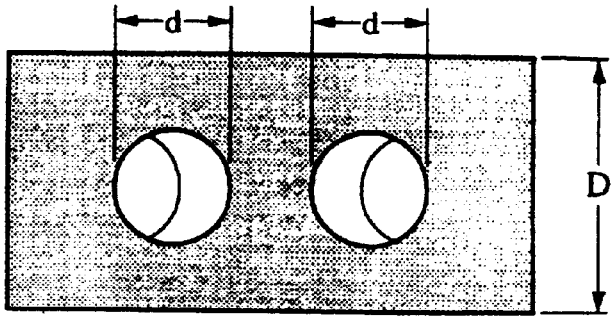
FIGS. 4A and 4B illustrate a state in which the coupling coefficient is changed from the state shown in FIG. 2A and 2B.
Figure 4B:
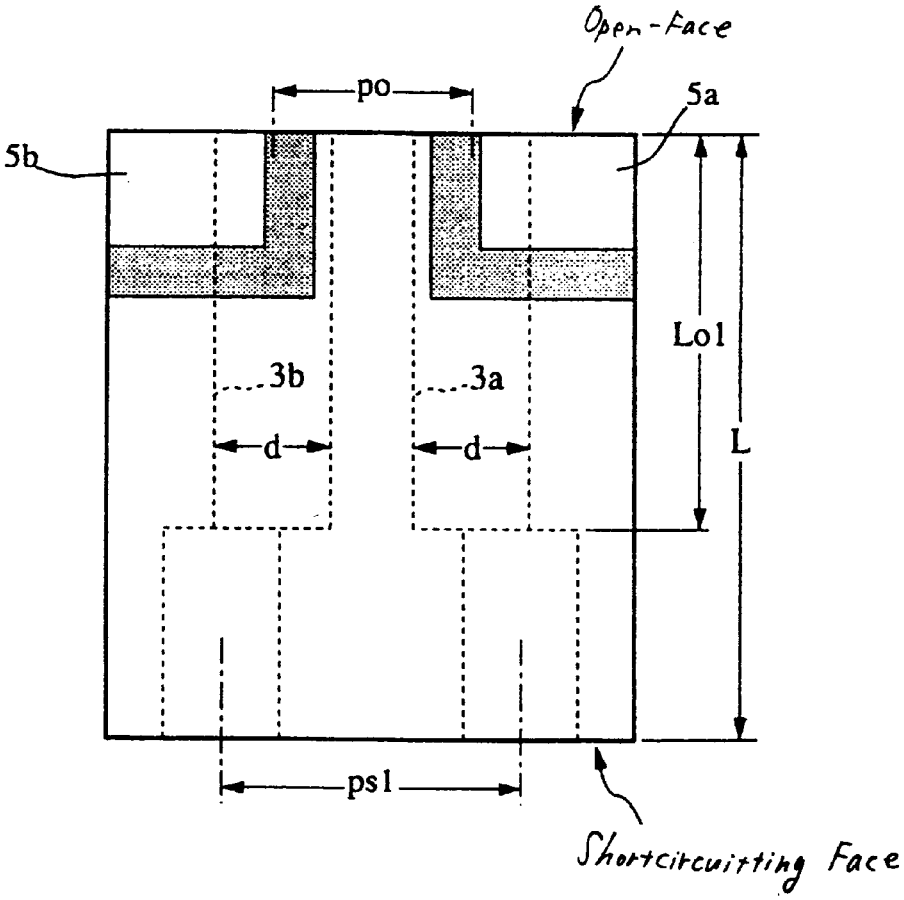
Figure 5A:
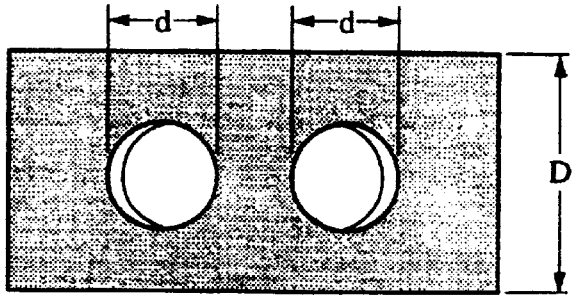
FIGS. 5A and 5B illustrate the resonators which are inductive-coupled with each other.
Figure 5B:
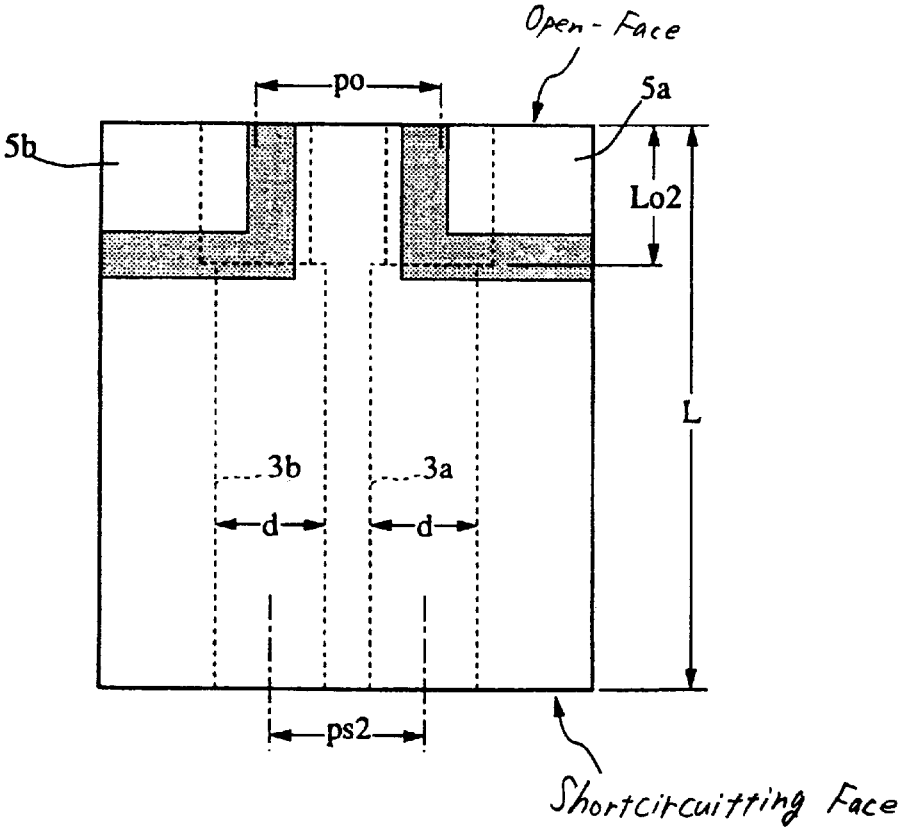

The coupling coefficient between resonators is determined by the position (L-Lo where Lo and L represent line lengths on the open-face side and on the short-circuiting-face side, respectively) of steps each provided on the center axes of the inner conductor formed holes, a resonator pitch po on the open-face side, and a resonator pitch ps1 on the short-circuiting-face side. For example, as shown in FIGS. 4A and 4B, as the resonator pitch po on the open-face side is set to be shorter than the resonator pitch ps1 on the short-circuiting-face side. and the step position Lo 1 of the center axes of the inner conductor formed holes is deeper, the coupling is more capacitive, and the coupling coefficient is increased. Further, as shown in FIGS. 5A and 5B, as the resonator pitch ps2 on the short-circuiting-face side is set to be shorter than the resonator pitch po on the open-face side, and the Lo2 is shallower, the coupling is more inductive, and as a whole, the resonators are inductive-coupled.

Next, the configuration of a dielectric filter according to a second embodiment will be described with reference to FIGS. 6A, 6B and FIGS. 7A, 7B.

Figure 6A:
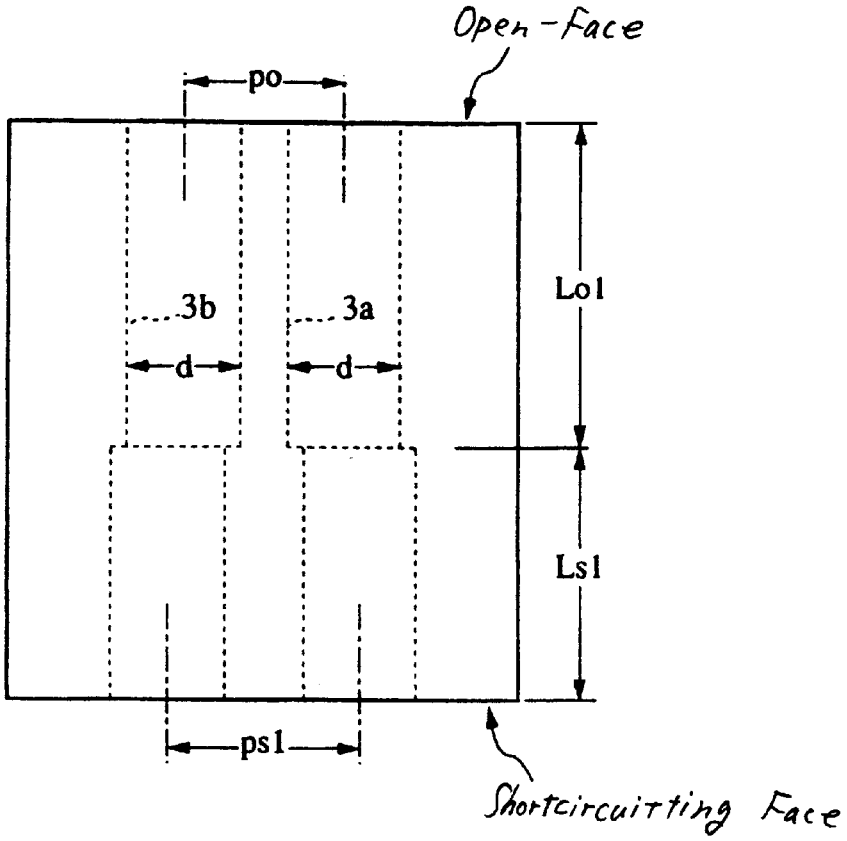
FIGS. 6A and 6B illustrate the Qo which is optimized in the resonator-arrangement direction, as an example.
Figure 6B:
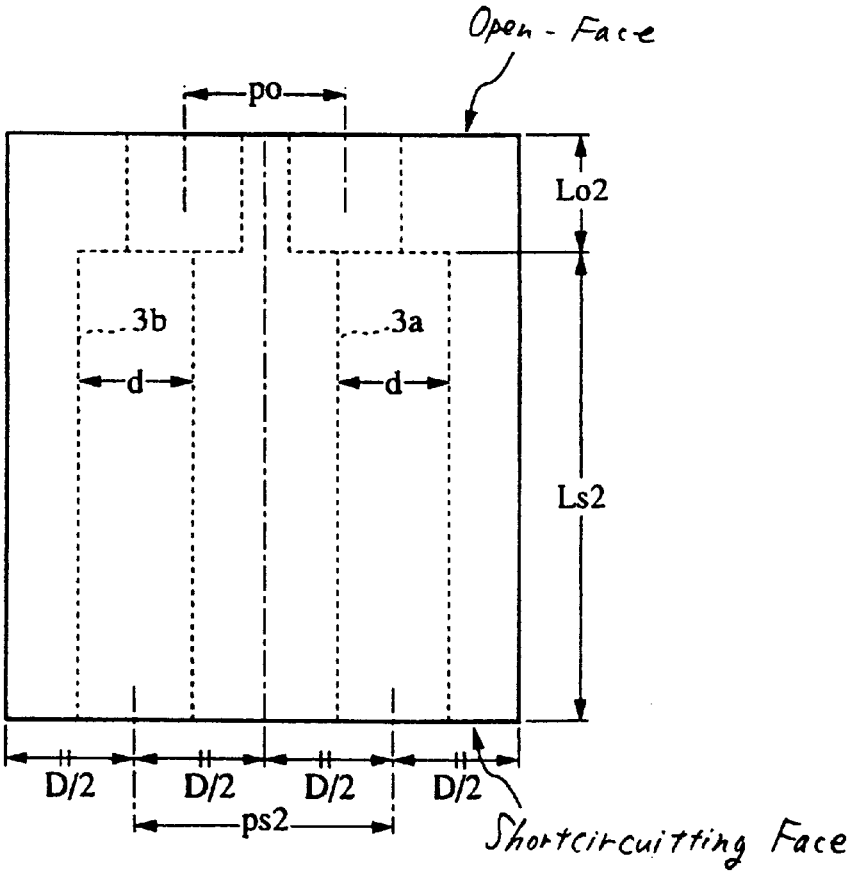

In an example shown in FIG. 6A, the capacitive coupling is more intensified as compared with the inductive coupling by setting the resonator pitch po on the open-face side to be shorter than the resonator pitch ps1 on the short-circuiting-face side. The coupling of the filter shown in FIG. 6B has a further improved $Q_o$, though the coupling coefficient is equal to that of the filter shown in FIG. 6A. That is, in the coupling of the filter shown in FIG. 6B, the line length Ls2 on the short-circuiting-face side is set to be longer than the line length Lo2 on the open-face side, correspondingly, the resonator pitch ps2 on the short-circuiting-face side is set to be longer than the ps1 of FIG. 6A, and moreover, and the resonator pitch ps2 on the short-circuiting-face side is set to be about two times the interval (D/2) between the center axis of each inner conductor formed hole and the outer conductor.

Figure 7A:
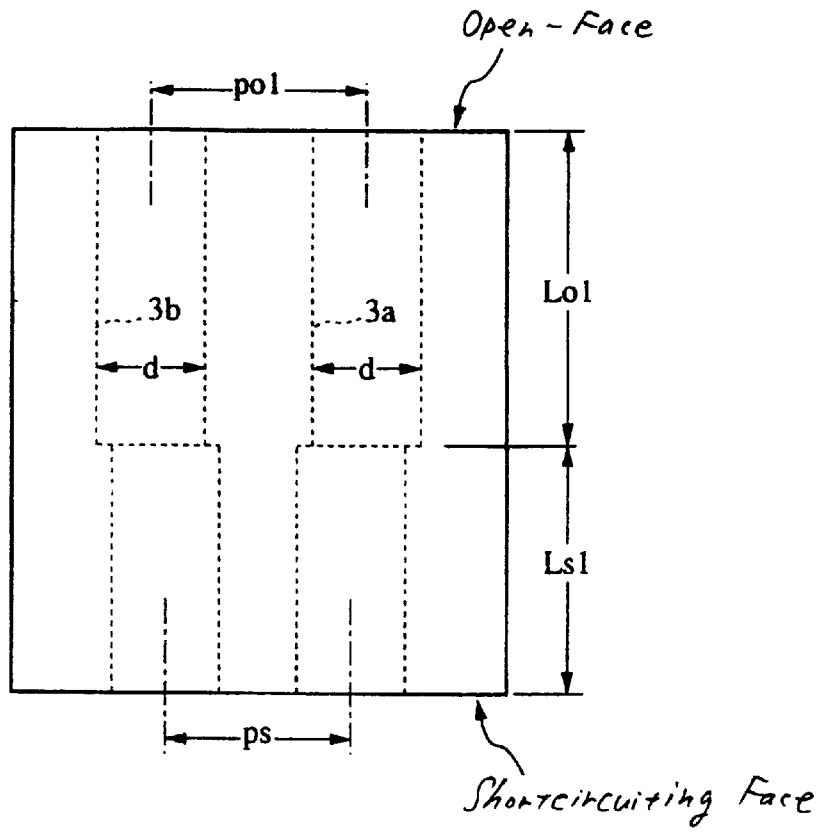
FIGS. 7A and 7B illustrate the Qo which is optimized in the resonator-arrangement direction, as an example.
Figure 7B:
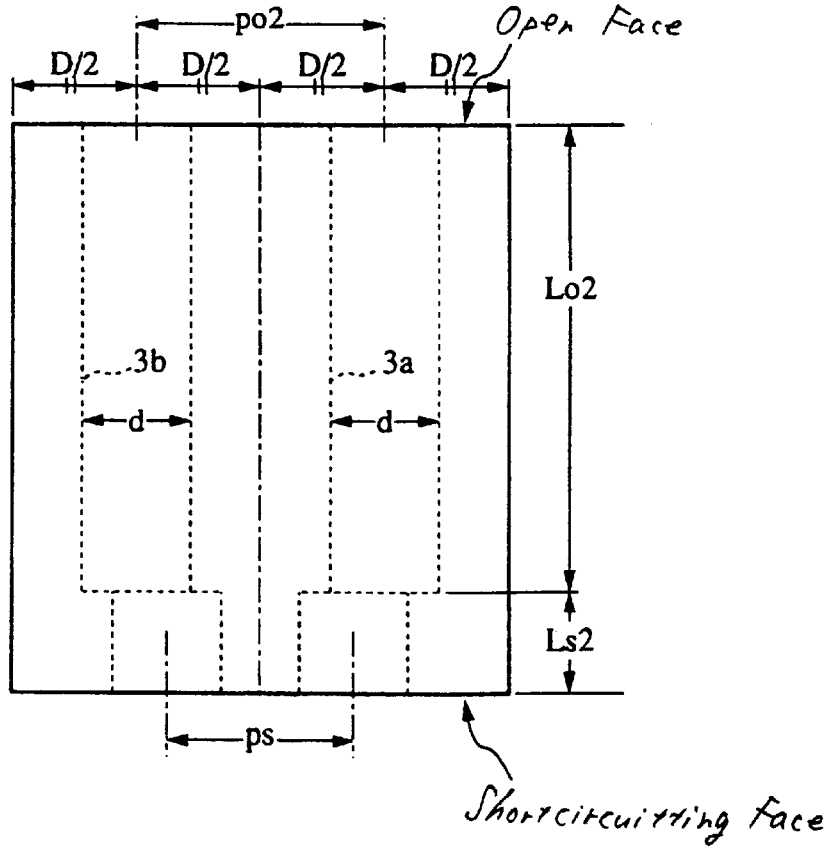

FIGS. 7A and 7B illustrate an example of inductive-coupling the resonators. In an example shown in FIG. 7A, the inductive coupling is more intensified as compared with the capacitive coupling by setting the resonator pitch ps on the short-circuiting-face side to be shorter than the resonator pitch po1 on the open-face side. The coupling of the filter shown in FIG. 7B has a further improved $Q_o$, though the coupling coefficient is equal to that of the filter shown in FIG. 7A. That is, in the coupling of the filter shown in FIG. 7B, the line length Lo2 on the open-face side is set to be longer than the line length Ls2 on the short-circuiting-face side, correspondingly, the resonator pitch po2 on the open-face side is set to be longer than the ps1 of FIG. 7A, and moreover, and the resonator pitch po2 on the open-face side is set to be about two times the interval (D/2) between the center axis of each inner conductor formed hole and the outer conductor.

In the above-described structure, a large part of the center axes of the inner conductor formed holes are positioned in the centers of the two divided areas of the dielectric block, respectively. That is, if the two divided areas of the dielectric block are regarded as two stage co-axial resonators, the inner conductors are positioned in the centers of the respective resonators. As a result, especially the Qo of the odd mode is enhanced, that is, the reduction of the Qo is suppressed.

Figure 8A:
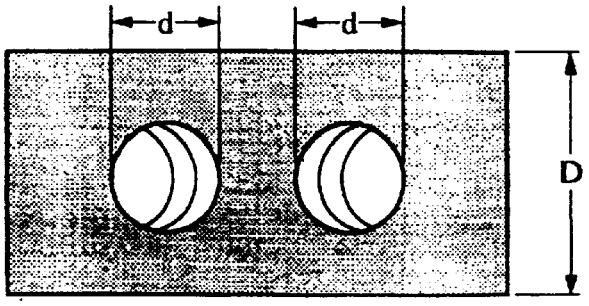
FIGS. 8A and 8B are a front view and a bottom view showing a dielectric filter according to a third embodiment.
Figure 8B:
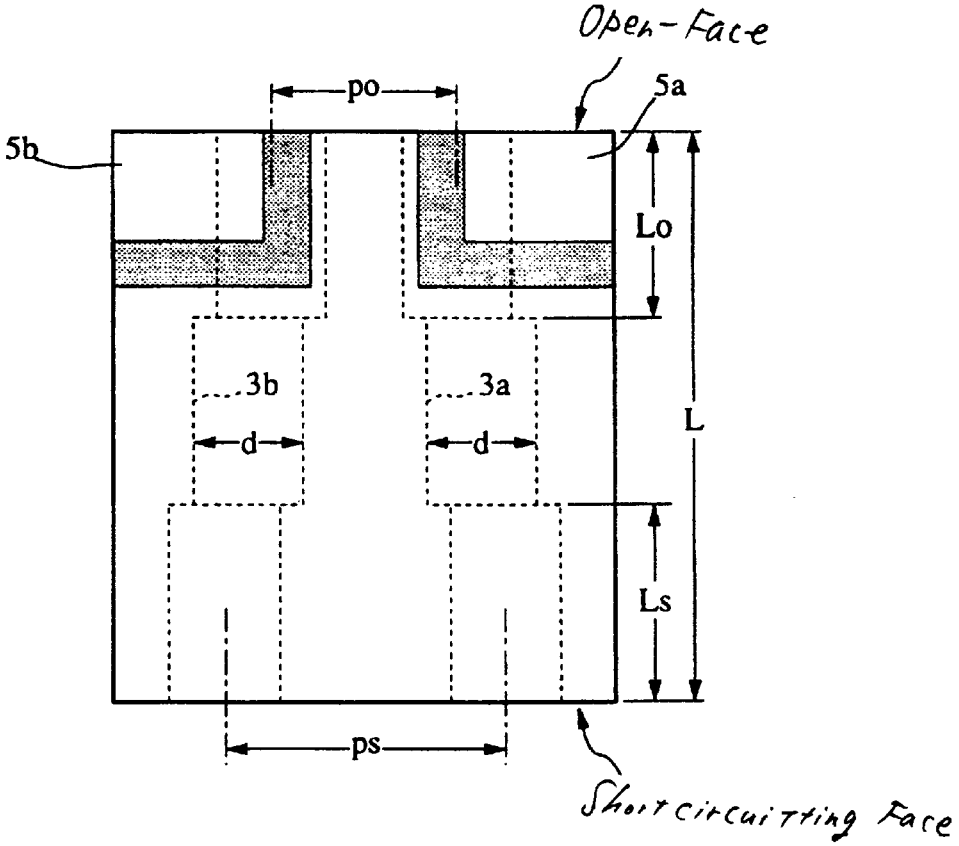

Next, the configuration of a dielectric filter according to a third embodiment will be described with reference to FIGS. 8A and 8B.

In the previously-described embodiments, a step is provided only at one position of the center axis of each inner conductor formed hole. However, as shown in FIGS. 8A and 8B, the center axis may be shifted at two positions thereof. In an example shown in FIGS. 8A and 8B, the resonator pitch in the range from the open-face to the depth Lo is po, and the resonator pitch in the range from the short-circuiting-face to the depth Ls is ps. The resonator pitch in the intermediate range between the above-mentioned ranges is set to have nearly a middle value between the po and the ps. In any position, the inner diameter of the inner conductor formed holes is constant, and is represented by d.

Figure 9A:
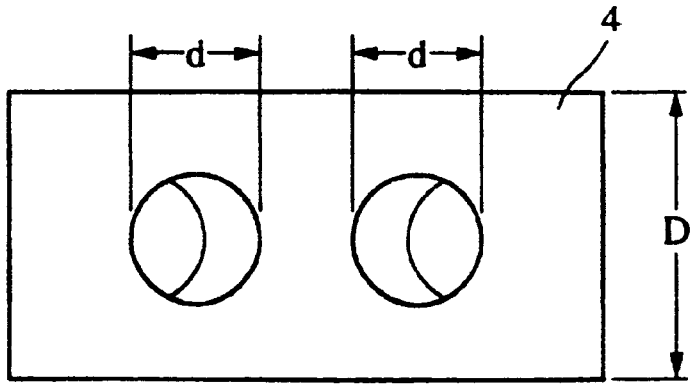
FIGS. 9A and 9B are a front view and a bottom view showing a dielectric filter according to a fourth embodiment.
Figure 9B:
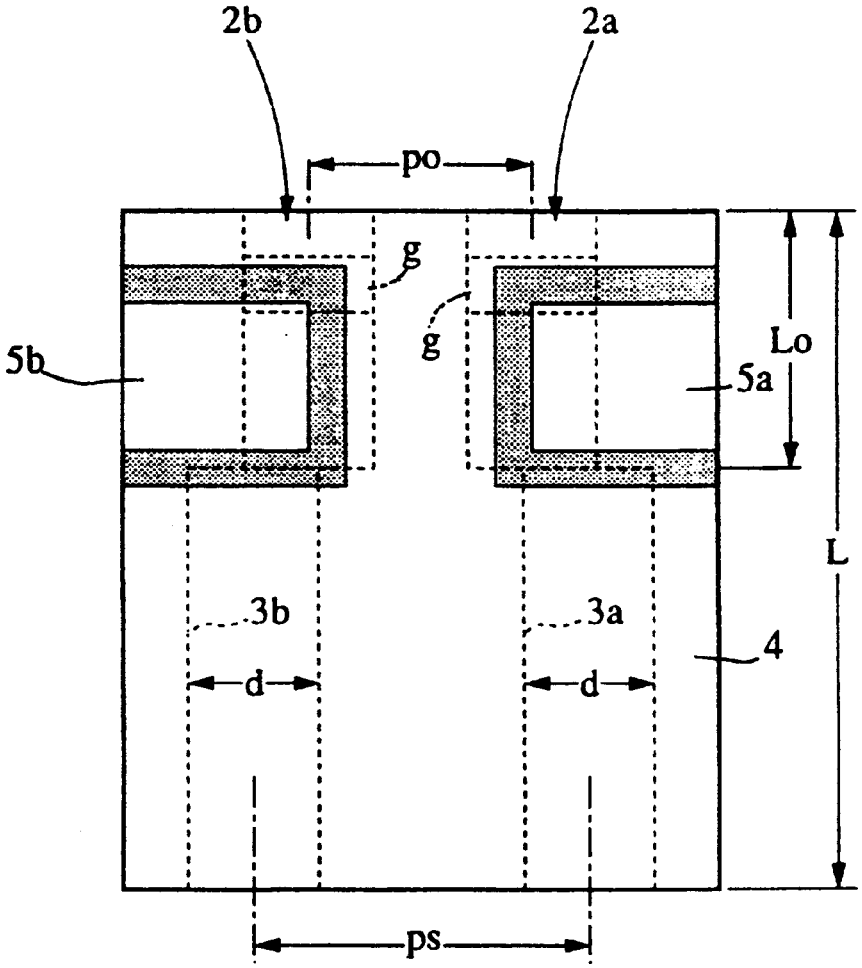

Next, the configuration of a dielectric filter according to a fourth embodiment will be described with reference to FIGS. 9A and 9B.

In each of the above-described embodiments, one end-face of a dielectric is an open-face. However, the open-end of a resonator may be provided inside of the inner conductor formed hole or in the vicinity of the opening-portion thereof. That is, in an example shown in FIGS. 9A and 9B, an outer conductor 4 is formed on all of the six outer-faces of the dielectric block. Inner conductors 3*a* and 3*b* are formed on the inner walls of inner conductor formed holes 2*a* and 2*b*. Parts g are formed on the inner walls by partially excluding the inner conductors 3*a* and 3*b*, respectably. In this structure, the parts g are open-ends of the resonators. A stray capacitance is generated between the open-end of each inner conductor and the outer conductor, in the part g. In the dielectric filter having such a structure, the inner diameter d of the inner conductor formed holes 2*a* and 2*b* is set in such a manner that the Qo becomes maximum.

Figure 10A:
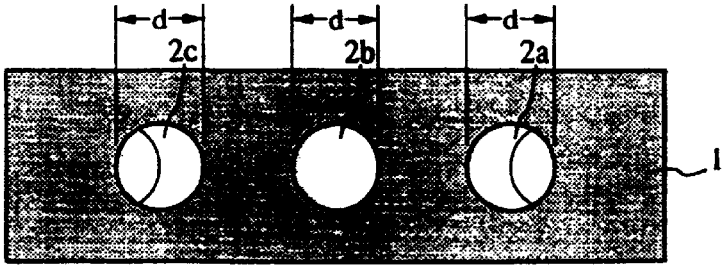
FIGS. 10A and 10B are a front view and a bottom view showing a dielectric filter according to a fifth embodiment.
Figure 10B:
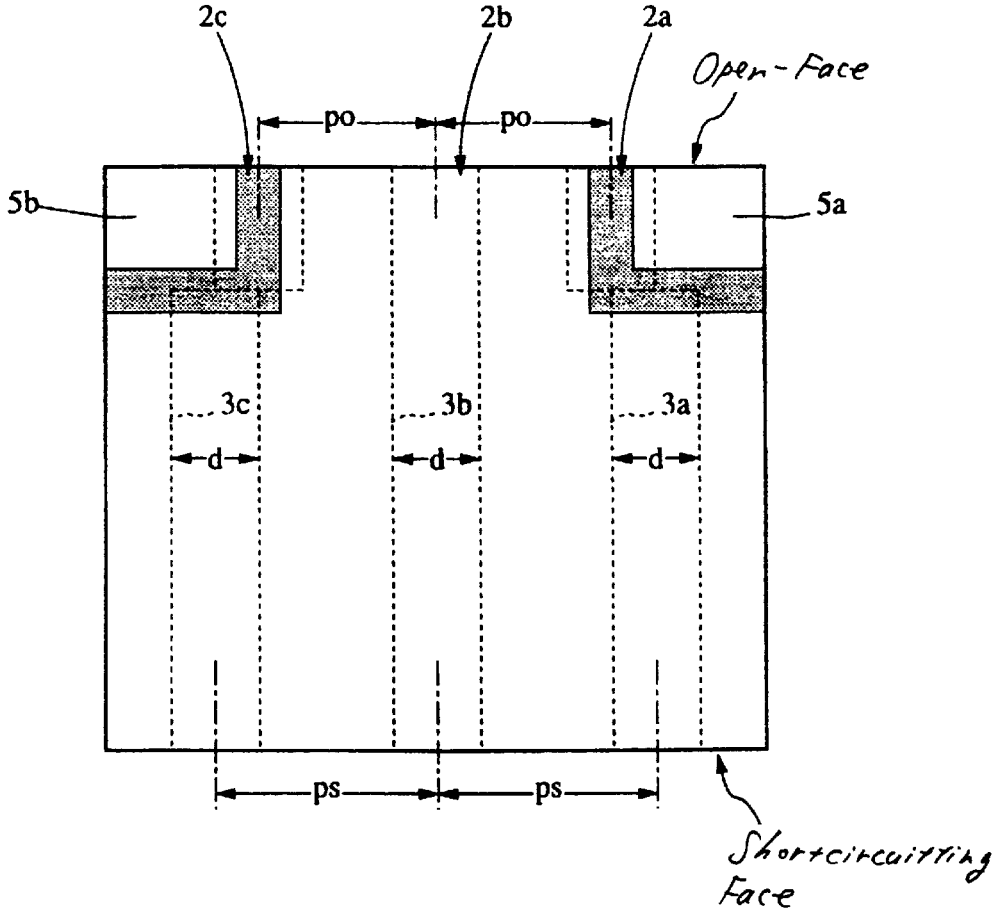

Next, the structure of a dielectric filter according to a fifth embodiment will be described with reference to FIGS. 10A and 10B.

In this example, steps are provided at predetermined positions of the center axes of the inner conductor formed holes 2*a* and 2*c*, respectively. The resonator pitch on the open-face side is set to be shorter than the resonator pitch ps on the short-circuiting-face side. Therefore, a dielectric filter in which three-stage resonators are capacitive-coupled with each other, having a band-pass characteristic is provided.

Next, the configuration of a dielectric filter according to a sixth embodiment will be described with reference to FIGS. 11A, 11B and FIG. 12.

Figure 11A:
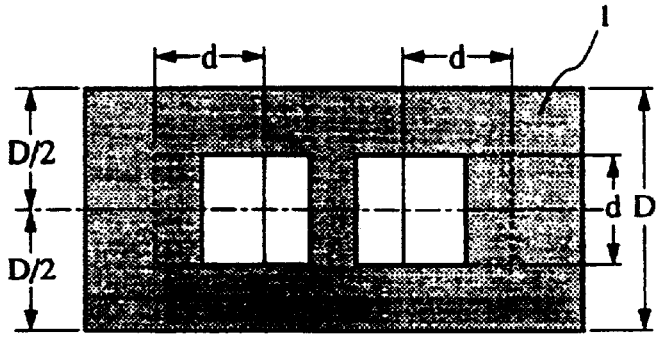
FIGS. 11A and 11B are a front view and a bottom view showing a dielectric filter according to a sixth embodiment.
Figure 11B:
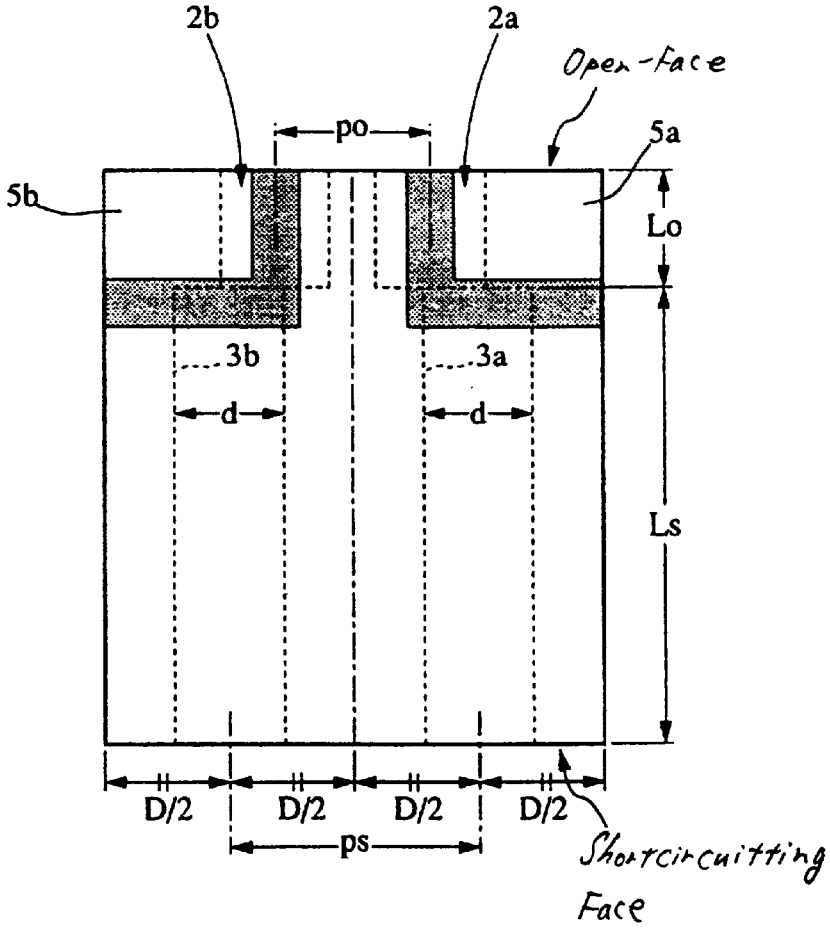
Figure 12:
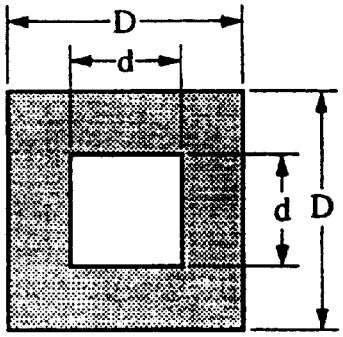
FIG. 12 illustrates the relation between the width of the dielectric block and the width of the inner conductor formed hole.

FIG. 11A is a front view showing the open-face side of the above-described dielectric filter, and FIG. 11B is a bottom view thereof. As shown in the figures, the inner conductor formed holes 2*a* and 2*b* each have a square cross-section. At the position of the depth Lo from the open-face where the line length on the open-face side is Lo, a step is provided for the center axis, the resonator pitch on the open-face side is po, and the resonator pitch on the short-circuiting-face side is ps. The widths of the inner conductor formed holes 2*a* and 2*b* are constant in the range from the open-face to the short-circuiting-face, respectively.

In each embodiment described above, an inner conductor formed hole has a circular cross section. As shown in FIGS. 11A and 11B, the hole may have a square cross section. Hereupon, as shown in FIG. 12, an example in which an inner conductor formed hole having a square cross section is formed in a dielectric block is discussed. The Qo of the resonator, changing with the ratio of d/D where D represents the width in the longitudinal, transverse directions of the dielectric block, and d represents the width of the inner conductor formed hole was determined by the finite element method. Similarly to the case shown in FIG. 3, the Qo has a large value in the range of the d/D of 0.2–0.4. Accordingly, the high Qo is secured by setting the width D of the dielectric block shown in FIG. 1 and the width d of the inner conductor formed holes 2*a* and 2*b* so as to have a relation of d/D =0.2–0.4.

Further, the cross section of the above-described inner conductor formed holes may have the 'square cross-section' of which the comers are more or less rounded in order to prevent the ceramic from being cracked at firing.

Next, the configuration of a dielectric duplexer according to a seven embodiment will be described with reference to FIGS. 13A, 13B and 13C.

Figure 13A:
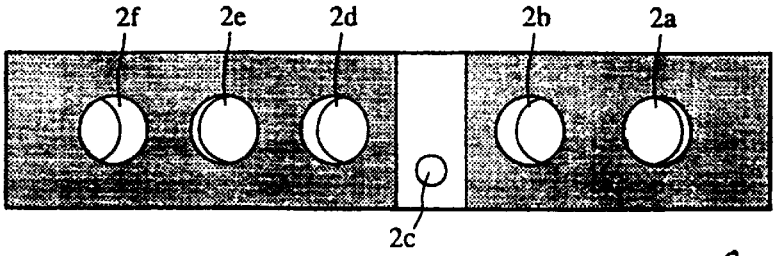
FIGS. 13A, 13B and 13C are a front view and bottom views showing a dielectric filter according to a seventh embodiment.
Figure 13B:
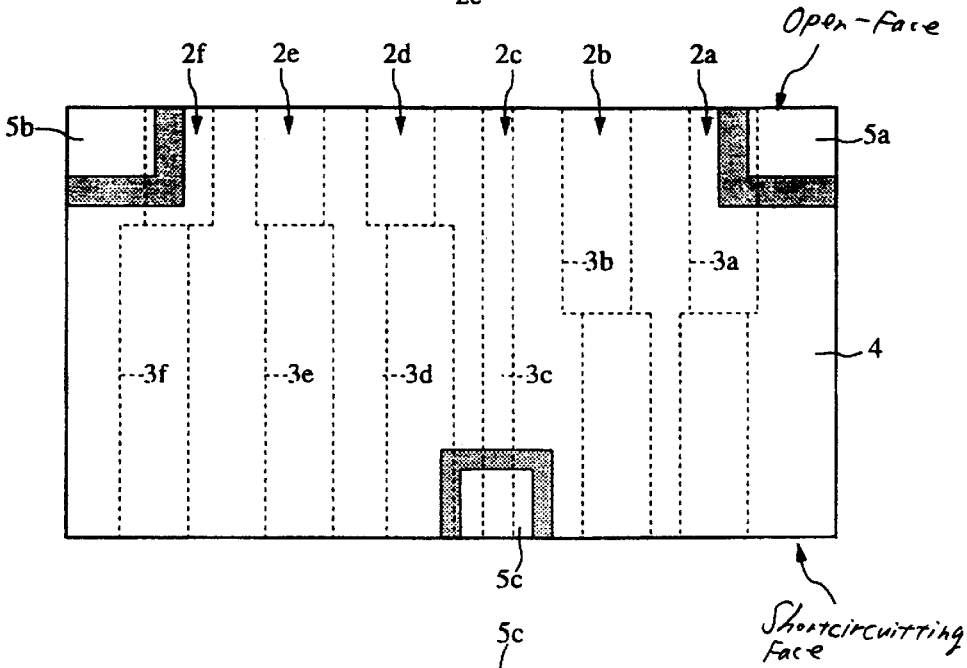
Figure 13C:
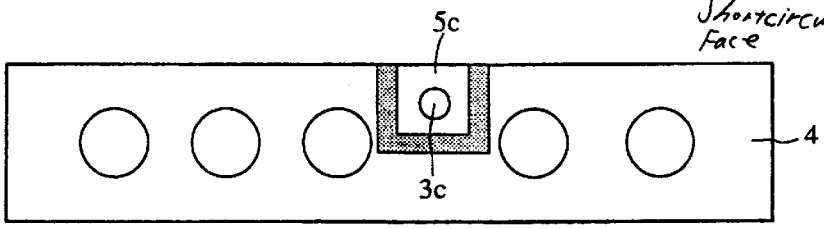

FIG. 13A is a front view showing the dielectric duplexer viewed from the open-face side, FIG. 13B is a bottom view thereof, and FIG. 13C is a rear elevation thereof. The rear elevation is drawn with the bottom face being positioned upward, viewed in the figure. In this example, six inner conductor formed holes 2*a*–2*f* are formed in the range from one end-face of a parallelepiped-shaped dielectric block 1 to the other, opposite end-face. Inner conductors 3*a*–3*f* are provided on the inner walls of these inner conductor formed holes, respectively.

On the outer surface of the dielectric block 1, an outer conductor 4, and moreover, input-output terminals 5*a*, 5*b*, and 5*c* are formed. Regarding the inner conductor 3*c* on the inner wall of the inner conductor formed hole 2*c*, one end thereof is connected to the outer conductor 4 on the outer surface of the dielectric block, and the other end is connected to the input-output terminal 5*c*.

Regarding the inner conductor portions 3*a* and 3*b*, steps are provided for the center axes of their inner conductor formed holes so that the resonator pitch on the short-circuiting-face side and the resonators is shortened, and thereby, the resonators are capacitive-coupled with each other. The resonator formed of the inner conductor 3*b* is interdigitally-coupled with the inner conductor 3*c*. Similarly, the resonator formed of the inner conductor 3*d* is interdigitally-coupled with the inner conductor 3*c*. With this structure, the dielectric duplexer acts as such in which for example, the two-stage resonator comprising the inner conductors 3*a* and 3*b* is a transmission filter, and a band-pass filter comprising the three-stage resonator formed of the inner conductors 3*d*, 3*e*, and 3*f* is a reception filter. In this case, the input-output terminals 5*a*, 5*b*, and 5*c* are a transmission signal input port, a reception signal output port, and an antenna port, respectively.

Next, the configuration of a communication apparatus using the above-described dielectric filter or duplexer will be described with reference to FIG. 14. In the figure, ANT represents a recepton-transmission antenna, DPX a duplexer, BPFa, BPFb, and BPFd band-pass filters, respectively, AMPa and AMPb amplification circuits, respectively, MIXa and MIXb mixers, respectively, OSC an oscillator, and DIV a frequency divider (synthesizer). The MIXa modulates with a modulation signal a frequency signal output from the DIV. The BPFa passes only the transmission frequency band of the signal, which is power-amplified by the AMPa, and transmitted from the ANT through the DPX. The BPFb passes only the reception frequency band of a signal output from the DPX, which is amplified by the AMPb. The MIXb mixes a frequency signal output from the BPFc with the reception signal to output an intermediate frequency signal IF.

Figure 14:
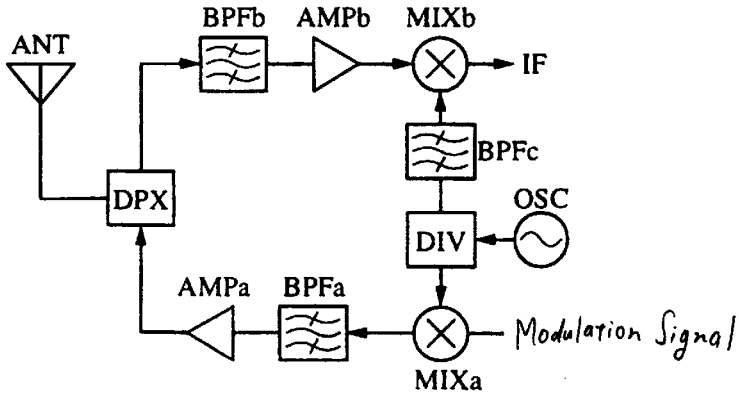
FIG. 14 is a block diagram showing the configuration of a communication apparatus.

For the duplexer DPX section shown in FIG. 14, the duplexer having the structure shown in FIG. 13 may be employed. Further, for the band-pass filters BPFa, BPFb, and BPFc, the dielectric filter having the structure shown in FIGS. 1 to 11B may be employed. Like this, a communication apparatus with a low loss, making use of the high Qo filter characteristic, can be formed without the size being enlarged as a whole.

While the invention has been particularly shown and described with reference to preferred embodiments thereof, it will be understood by those skilled in the art that the forgoing and other changes in form and details may be made therein without departing from the spirit of the invention.

What is claimed is:

1. A dielectric filter, comprising:

a dielectric block;

a plurality of holes having first and second ends, provided in the dielectric block;

inner conductors provided on the inner walls of the holes; and an outer conductor provided on the outer surface of the dielectric block so as to be disconnected from said inner conductors at the first end of the holes, and short-circuited to said inner conductors at the second end thereof, wherein the sectional shape of at least one of the holes is substantially constant in a range from the first end to the second end, and a step is provided in said at least one hole between the first end and the second end;

whereby, in said at least one of the holes, a central axis of the hole when viewed from the first end and a central axis of the hole when viewed from the second end are offset.

2. A dielectric filter, comprising:

a dielectric block;

a plurality of holes having first and second ends, provided in the dielectric block;

inner conductors provided respectively on the inner walls of the holes and corresponding gaps formed in said inner conductors on the inner walls of the holes between the first and second ends; and an outer conductor provided on the outer surface of the dielectric block, said outer conductor being short-circuited to said inner conductors at both ends of said holes;

wherein the sectional shape of at least one of the holes is substantially constant in a range from the first end to the second end, and a step is provided in said at least one hole between the first end and the second end;

whereby, in said at least one of the holes, a central axis of the hole when viewed from the first end and a central axis of the hole when viewed from the second end are offset.

3. The dielectric filter according to claim 1 or 2, wherein each of the holes has a square cross section.

4. A dielectric duplexer comprising a pair of dielectric filters according to any one of claims 1 and 2, the dielectric filters being formed in the same said dielectric block.

5. The dielectric filter according to claim 3, wherein the ratio dLD is 0.2–0.4, where D represents the width in the short side direction of the dielectric block, and d represents the width of the holes.

6. The dielectric filter according to claim 5, wherein the position of the step is nearer to one end than to the other end of the corresponding hole, and the interval between the center axis of the hole ranging from the step to the other end of the hole and the center axis of an adjacent hole is substantially two times the interval between each center axis and a corresponding adjacent portion of the outer conductor.

7. The dielectric filter according to claim 3, wherein the position of the step is nearer to one end than to the other end of the corresponding hole, and the interval between the center axis of the hole ranging from the step to the other end of the hole and the center axis of an adjacent hole is substantially two times the interval between each center axis and a corresponding adjacent portion of the outer conductor.

8. A communication apparatus comprising:

a high-frequency circuit comprising at least one of a transmission circuit and a reception circuit; and the dielectric filter of any one of claims 1 and 2 connected to said high-frequency circuit.

9. A communication apparatus comprising:

a transmission circuit;

a reception circuit; and the duplexer of claim 6, wherein said pair of dielectric filters are connected respectively to said transmission circuit and said reception circuit, and said pair of dielectric filters are connected in common to an antenna terminal.

10. A dielectric filter, comprising:

a dielectric block;

a plurality of holes provided in the dielectric block;

inner conductors provided on the inner walls of the holes; and an outer conductor provided on the outer surface of the dielectric block so as to be disconnected from said inner conductors at a first end of the holes, and short-circuited to said inner conductors at the second end thereof, wherein the sectional shapes of the holes are substantially constant in the range from the first end to the second end, and a step is provided in at least one hole between the first end and the second end; and wherein the ratio d/D is 0.2–0.4, where D represents the width in the short side direction of the dielectric block, and d represents the width of the holes.

11. The dielectric filter according to claim 10, wherein the position of the step is nearer to one end than to the other end of the corresponding hole, and the interval between the center axis of the hole ranging from the step to the other end of the hole and the center axis of an adjacent hole is substantially two times the interval between each center axis and a corresponding adjacent portion of the outer conductor.

12. A dielectric filter, comprising:

a dielectric block;

a plurality of holes having first and second ends, provided in the dielectric block;

inner conductors provided on the inner walls of the holes and corresponding gaps formed in said inner conductors on the inner walls of the holes between the first and second ends; and an outer conductor provided on the outer surface of the dielectric block, the outer conductor being short-circuited to said inner conductors at both ends of said holes;

wherein the sectional shapes of the holes are substantially constant in the range from the first ends to the second ends of the holes, respectively, and a step is provided in at least one hole between the first end and the second end; and wherein the ratio d/D is 0.2–0.4, where D represents the width in the short side direction of the dielectric block, and d represents the width of the holes.

13. The dielectric filter according to claim 12, wherein the position of the step is nearer to one end than to the other end of the corresponding hole, and the interval between the center axis of the hole ranging from the step to the other end of the hole and the center axis of an adjacent hole is substantially two times the interval between each center axis and a corresponding adjacent portion of the outer conductor.

14. A dielectric filter, comprising:

a dielectric block;

a plurality of holes provided in the dielectric block;

inner conductors provided on the inner walls of the holes; and an outer conductor provided on the outer surface of the dielectric block so as to be disconnected from said inner conductors at a first end of the holes, and short-circuited to said inner conductors at the second end thereof, wherein the sectional shapes of the holes are substantially constant in the range from the first end to the second end, and a step is provided in at least one hole between the first end and the second end; and wherein the position of the step is nearer to one end than to the other end of the corresponding hole, and the interval between the center axis of the hole ranging from the step to the other end of the hole and the center axis of an adjacent hole is substantially two times the interval between each center axis and a corresponding adjacent portion of the outer conductor.

15. The dielectric filter according to claim 14, wherein the ratio d/D is 0.2–0.4, where D represents the width in the short side direction of the dielectric block, and d represents the width of the holes.

16. A dielectric filter, comprising:

a dielectric block;

a plurality of holes having first and second ends, provided in the dielectric block;

inner conductors provided on the inner walls of the holes and corresponding gaps formed in said inner conductors on the inner walls of the holes between the first and second ends; and an outer conductor provided on the outer surface of the dielectric block, the outer conductor being short-circuited to said inner conductors at both ends of said holes;

wherein the sectional shapes of the holes are substantially constant in the range from the first ends to the second ends of the holes, respectively, and a step is provided in at least one hole between the first end and the second end; and wherein the position of the step is nearer to one end than to the other end of the corresponding hole, and the interval between the center axis of the hole ranging from the step to the other end of the hole and the center axis of an adjacent hole is substantially two times the interval between each center axis and a corresponding adjacent portion of the outer conductor.

17. The dielectric filter according to claim 16, wherein the ratio d/D is 0.2–0.4, where D represents the width in the short side direction of the dielectric block, and d represents the width of the holes.

* * * * *